US011982145B2

(12) United States Patent
Wiener et al.

(10) Patent No.: US 11,982,145 B2
(45) Date of Patent: May 14, 2024

(54) UNDERWATER DRILLING DEVICE AND METHOD FOR PROCURING DRILL CORES OF A BED OF A BODY OF WATER

(71) Applicant: BAUER Maschinen GmbH, Schrobenhausen (DE)

(72) Inventors: Johannes Wiener, Münster (DE); Leonhard Weixler, Thierhaupten (DE); Tobias Greindl, Munich (DE); Stefan Michael Finkenzeller, Reichertshofen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 116 days.

(21) Appl. No.: 17/299,289

(22) PCT Filed: Dec. 20, 2018

(86) PCT No.: PCT/EP2018/086116
§ 371 (c)(1),
(2) Date: Jun. 2, 2021

(87) PCT Pub. No.: WO2020/125986
PCT Pub. Date: Jun. 25, 2020

(65) Prior Publication Data

US 2022/0003062 A1 Jan. 6, 2022

(51) Int. Cl.
*E21B 25/18* (2006.01)
*E21B 7/124* (2006.01)
(Continued)

(52) U.S. Cl.
CPC ..... *E21B 25/18* (2013.01); *E21B 7/124* (2013.01); *E21B 25/005* (2013.01); *E21B 49/025* (2013.01)

(58) Field of Classification Search
CPC ..... E21B 25/18; E21B 7/124; E21B 25/005; E21B 49/025; E21B 41/0007
See application file for complete search history.

(56) References Cited

U.S. PATENT DOCUMENTS 3,491,842 A * 1/1970 Castela ..... E21B 7/124 175/6
3,516,503 A * 6/1970 Schaller, Jr. ..... E21B 7/124 175/6
(Continued)

FOREIGN PATENT DOCUMENTS

CN 101532922 A 9/2009
CN 102606074 A 7/2012
(Continued)

OTHER PUBLICATIONS

International Preliminary Report on Patentability issued in PCT/EP2018/086116; completed Mar. 3, 2021.
(Continued)

*Primary Examiner* — James G Sayre
(74) *Attorney, Agent, or Firm* — Studebaker & Brackett PC

(57) ABSTRACT

The invention relates to an underwater drilling device and to a method for procuring drill cores of a bed of a body of water, wherein an underwater drilling device with a base frame is lowered in a body of water and placed on a bed of a body of water. A drill string consisting of at least one tubular drill string element is drilled out into the bed of the body of water in a first drilling step with a drill drive, with a drill core being formed in a receptacle in the tubular drill string element and being received in a core barrel in the drill string element. According to the invention, the drill core is enclosed in pressure-tight manner in a receiving container on the basic cradle under water.

12 Claims, 12 Drawing Sheets

(51) Int. Cl.
*E21B 25/00* (2006.01)
*E21B 49/02* (2006.01)

(56) References Cited

U.S. PATENT DOCUMENTS

| | | | | | |
|---|---|---|---|---|---|
| 3,701,387 | A * | 10/1972 | Koot | E21B 25/18 | 175/6 |
| 4,071,099 | A * | 1/1978 | Hensel, Jr. | E21B 25/005 | 73/864.91 |
| 4,317,490 | A * | 3/1982 | Milberger | E21B 25/18 | 175/20 |
| 7,380,614 | B1 | 6/2008 | Williamson et al. | | |
| 2006/0016621 | A1* | 1/2006 | Jackson | E21B 41/04 | 175/7 |
| 2009/0178847 | A1 | 7/2009 | Nellessen, Jr. et al. | | |
| 2009/0229382 | A1 | 9/2009 | Sun et al. | | |
| 2013/0206476 | A1* | 8/2013 | Innes | E21B 41/04 | 175/6 |
| 2016/0003038 | A1* | 1/2016 | Smith | E21B 49/025 | 175/246 |
| 2020/0248518 | A1* | 8/2020 | Wan | E21B 25/18 | |

FOREIGN PATENT DOCUMENTS

| | | | |
|---|---|---|---|
| DE | 10 2008 049 795 | A1 | 4/2010 |
| WO | 2011/161415 | A2 | 12/2011 |
| WO | 2012/000077 | A1 | 1/2012 |
| WO | 2015/172818 | A1 | 11/2015 |
| WO | 2016/146989 | A1 | 9/2016 |

OTHER PUBLICATIONS

International Search Report issued in PCT/EP2018/086116; dated Aug. 21, 2019.

An Office Action mailed by the Korean Intellectual Property Office dated May 19, 2023, which corresponds to Korean Patent Application No. 10-2021-7017539 and is related to U.S. Appl. No. 17/299,289; with English translation.

An Office Action mailed by the China National Intellectual Property Administration dated Nov. 4, 2022, which corresponds to Chinese Patent Application No. 201880100363.9 and is related to U.S. Appl. No. 17/299,289; with English translation.

An Office Action mailed by the China National Intellectual Property Administration dated Jun. 10, 2023, which corresponds to Chinese Patent Application No. 201880100363.9 and is related to U.S. Appl. No. 17/299,289; with English translation.

An English translation of the Search Report mailed by the China National Intellectual Property Administration dated Oct. 31, 2022, which corresponds to Chinese Patent Application No. 201880100363.9 and is related to U.S. Appl. No. 17/299,289.

* cited by examiner

UNDERWATER DRILLING DEVICE AND METHOD FOR PROCURING DRILL CORES OF A BED OF A BODY OF WATER

CROSS-REFERENCE TO RELATED APPLICATIONS

This application claims the benefit of priority to PCT Application PCT/EP2018/086116, filed on Dec. 20, 2018, which is hereby incorporated by reference in its entirety.

TECHNICAL FIELD

The invention relates to an underwater drilling device for procuring drill cores of a bed of a body of water, with a base frame which is designed to be lowered in a body of water and to be placed on the bed of the body of water, a drill drive for rotatably driving a drill string about a drilling axis, wherein the drill string is constructed at least of tubular drill string elements and additionally at least one core barrel for receiving a drill core is provided in the drill string elements, in accordance with the preamble of claim 1.

The invention furthermore relates to a method for procuring drill cores of a bed of a body of water, in which an underwater drilling device with a base frame is lowered in a body of water and placed on a bed of a body of water, and a drill string consisting of at least one tubular drill string element is drilled into the bed of the body of water in a first drilling step with a drill drive, with a drill core being formed in the tubular drill string element and being received in a core barrel in the drill string element, in accordance with the preamble of claim 8.

BACKGROUND

An underwater drilling device and a method of this type are disclosed by WO 2015/172818 A1. This known underwater drilling device is designed to subject procured drill cores, directly while still under water, to a first analysis by means of at least one sensor means which is attached to the base frame of the drilling device. Thus initial findings can be obtained using the drill cores while the underwater drilling device is still on the bottom of the body of water. This may be up to several thousand meters beneath the water surface. Compared with pure analysis outside the body of water once the underwater drilling device has been retrieved, a saving can thus be made in terms of working hours and lifting and lowering operations. The drill cores obtained are stored on the drilling device and can be lifted therewith.

Further conventional underwater drilling devices are known for example from WO 2012/000077 A1 or U.S. Pat. No. 7,380,614 B1.

For certain in-depth analyses of the drill cores, in many cases it continues to be necessary to bring the drill cores to a corresponding analysis means outside the body of water and to subject the drill cores to the desired in-depth investigations. The investigations serve to obtain as accurate as possible knowledge about the structure of the bottom of the body of water, which is of interest for example for exploration of mineral resources.

It has been established that, when retrieving drill cores which are stored on a base frame of the underwater drilling device, during the retrieval operation from the bottom of the body of water changes to the drill cores may occur which may adversely affect the in-formative value of later investigations and analyses.

In principle, closable core barrels are known for example from DE 10 2008 049 795 A1. However, these plus the closure are located within the drill string and are closed within the drill string.

SUMMARY

The object of the invention is to devise an underwater drilling device and a method for procuring drill cores of a bed of a body of water with which particularly reliable information about the bed of the body of water can be provided.

This object is achieved firstly by an underwater drilling device having the features of claim 1 and secondly by a method having the features of claim 8. Preferred embodiments of the invention are set forth in the respective dependent claims.

The underwater drilling device according to the invention is characterized in that the drill core, once it has been removed from the drill string, can be enclosed in pressure-tight manner in a receiving container on the base frame under water.

The invention is based on the finding that, in particular when removing drill cores from a bed of a body of water which lies several hundred or even several thousand meters beneath the water surface, changes to the state, the composition or the structure of the drill core obtained may occur merely because of the changing pressure conditions. These changes in such case may considerably adversely affect reliable information about the actual state and structure of the bottom of the body of water. This according to one finding of the invention applies particularly when the drill cores contain solids, liquids or gases which tend to change their form relatively readily in the event of a change in temperature or pressure. This applies in particular to what are called gas hydrates, in particular to methane hydrate, also known as methane ice, which occurs in large quantities in the sea bed and is of particular interest as a possible future energy source. Such methane hydrate forms from water and methane gas at a pressure of approximately 2 MPa and temperatures of 2 to 4° C. This corresponds approximately to the conditions found from a water depth of approx. 500 meters onwards. Above this water depth, therefore, methane hydrate can emerge from drill cores as a gas and volatilize.

According to the invention, securing the drill core by receiving the drill core in a receiving container and by pressure-tight closing of this receiving container is achieved still under water.

Drill cores which are therefore enclosed in pressure-tight manner while still on the bottom of the body of water thus upon later analysis permit particularly reliable information on the structure, the state and the composition of the bottom of the body of water to be obtained. Pressure-tight enclosing of the drill core outside the drill string creates space in the drill string and thus makes it possible to obtain large drill cores, which improves their informative value about the nature of the ground.

In principle, the receiving container may be designed in any way whatsoever to receive the drill core. The receiving container may in principle also receive a plurality of drill cores. One particularly preferred embodiment of the invention consists in that the receiving container is formed by the core barrel or a drill string element, the barrel ends of which can be closed by means of a closing means. The closing means may in this case be in particular a manipulator means with which closure caps are applied to the barrel ends, which may also be called barrel openings or receiving openings.

The direct use of the core barrel as part of the receiving container results in an overall compact configuration of the underwater drilling device.

In accordance with the preferred embodiment, drill string elements are used as the receiving container, with both ends being provided with threads for screw connection to further drill string elements. These threads which are present may be used for screwing on the closure caps.

Alternatively, according to one development of the invention it is preferred that spaced apart from the drilling axis there is provided a storage means for at least one closable receiving container for the drill core, the receiving container being designed in cartridge-like manner with a receiving opening for introducing the drill core, that a manipulating means is arranged which is designed to introduce the drill core into the receiving container, and that a closing means is provided which is designed to close the receiving opening of the receiving container once the drill core has been received. The drill core may in this case, on its own or preferably together with the core barrel in which the drill core is held, be introduced into the receiving container. By means of the closing means, which comprises in particular a manipulator, the individual receiving opening on the cartridge-like or cup-like receiving container can be closed in pressure-tight manner by applying a closure cap. For this configuration according to the invention, conventional and hence correspondingly thin-walled core barrels can be used in a drill string.

In principle, the receiving container may be closed by any closure caps whatsoever. These may be fastened to the receiving container in particular by pressing-on, pushing-on, locking, gluing or in another way in non-positive manner, in positive manner or by a material-to-material bond. According to one variant embodiment of the invention, it is particularly advantageous that the closing means has at least one rotary drive which is designed to turn a closure cap with screw thread relative to the receiving container, with a suitable thread being arranged on the barrel openings or the receiving opening. The rotary drive may in this case also be formed by the drill drive of the drilling device itself. In this case, the closing means would comprise a manipulator for holding the closure cap at least for closing a lower barrel opening on a receiving container, while the drill drive drives the receiving container in rotation to form the screw connection. To screw a closure cap onto an upper receiving opening, a corresponding closure cap can be held on the drill drive, with the receiving container then itself being secured by means of a clamping unit as part of the closing means.

Alternatively, a standalone rotary drive may also be provided on a manipulator arm which grips a closure cap, moves it into the connection position and there by applying a rotary movement screws the closure cap onto a corresponding thread on the receiving container.

The storage means may be a simple cradle for holding the receiving containers or a motor-driven storage means, for example a rotatable revolving magazine or a revolving storage chain with holding elements.

One further advantageous embodiment of the invention consists in that the core barrel can be pulled out of the drill string by means of a manipulating means, and the manipulating means and the closing means are movable relative to each other. The manipulating means may in this case be designed such that it pulls the core barrel with the drill core merely axially upwards out of the drill string and holds the core barrel in the drilling axis. Then the receiving container can be moved into the drilling axis by the manipulating means for drill string elements. By axially moving the core barrel, the latter can then be introduced into the receiving container. The axial movement may be a lowering or a raising of the core barrel depending on the position of the receiving opening of the receiving container. Then the receiving container with the received drill core can be closed by means of the closing means.

Alternatively, the manipulating means may make possible a multi-axis movement of the core barrel with the drill core. Thus the core barrel can not only be pulled out of the drill string axially but then be moved transversely to the drilling direction to a receiving container, in order there to be introduced with the drill core into the receiving container.

The manipulating means may according to the invention also consist of a plurality of movable components with a plurality of grippers, with pivoting also being possible in addition to linear movement. In particular, a multi-axis robotic arm can be used for the manipulating means.

One preferred embodiment of the underwater drilling device according to the invention consists in that the manipulating means is a cable winch with lifting cable, or has at least one lifting cylinder. The cable winch with lifting cable may be used in particular also for pulling the core barrels out of the drill string. Preferably, the cable winch means may have on the upper side of the basic cradle an extension which makes it possible to pull a core barrel upwards out of the drill string and the box-shaped base frame and thus optionally to move the core barrel also above the base frame. Alternatively or additionally, a lifting cylinder which is preferably operated hydraulically, pneumatically or electrically may also be provided for this. Usually only one core barrel is located in the drill string. If the core barrel is filled with a drill core, the core barrel is pulled out of the drill string. Then for a further drilling step an empty core barrel can be inserted into the drill string.

According to a further embodiment of the invention, it is advantageous for the base frame to be connected to a supply vessel by way of a marine umbilical. The marine umbilical may in this case be provided both for supplying power, in particular electric power or hydraulic fluid, and as a data line for data communication. Furthermore, the marine umbilical may also be designed as a cable with which the underwater drilling device can be lowered and raised again in addition to the supplying function.

The method according to the invention is characterized in that the drill core is removed from the drill string and enclosed in pressure-tight manner in a receiving container under water. The method may be carried out in particular with the underwater drilling device previously described. In this case, the advantages previously described can be obtained.

At least one closure cap is provided for closing the receiving container. This cap may be provided with any connecting means for producing a pressure-tight connection. According to a preferred variant embodiment of the method according to the invention, provision is made for at least one closure cap to be screwed on with a screw thread to close the receiving container. In this case, the receiving container may be designed in cartridge-like manner as a tubular body with a closed base. On the receiving opening of the receiving container there is arranged a corresponding thread for forming a screw connection. The receiving container may also be formed by the tubular drill string element which is open on either side, with a corresponding thread being formed on the two opposing drill barrel ends in each case, onto which thread a corresponding closure cap is then screwed. The receiving container and/or the closure cap may be provided with a pressure relief valve in order to discharge excess pressure within the receiving container which exceeds a certain value and occurs during the transport of the drill core to the water surface, in order to avoid damage to the receiving container.

According to a further method variant of the invention, it is preferred for the core barrel to be pulled out of the drill string by means of a manipulating means, for the core barrel and the receiving container to be moved and axially aligned relative to each other, and, once axial alignment of the core barrel and receiving container has taken place, for the core barrel with the drill core to be moved into the receiving container by relative axial movement of the core barrel and receiving container. In this method variant, the receiving container is preferably designed in cartridge-like manner, so that the drill core together with the core barrel can be introduced in a simple manner.

An overall compact structure can be achieved according to a further method variant of the method according to the invention in that a receiving bore for the receiving container is created beneath the base frame in the bed of the body of water, and in that the core barrel is introduced into the receiving container in the receiving bore. The cartridge-like receiving container may in this case be introduced into the drill hole already present in particular once the drill string has been removed. Alternatively, a separate receiving bore may be formed in the bed of the body of water. This bore can be created by the drill head present on the drill string or by the receiving container itself. For this case, the receiving container may be provided at its lower end with a drilling or cutting means which supports the formation of the receiving bore by soil removal and/or displacement.

Once the core barrel has been introduced into the receiving container, it, prior to or after closing of the container, may be pulled out of the receiving bore again and stored on the base frame of the underwater drilling device.

One further expedient configuration of the method according to the invention consists in that the receiving container is moved into the drilling axis. With this method, in particular the core barrel with the drill core is moved into an upper supply position by a manipulating or lifting device. This may be performed in particular by means of a cable means which is also provided for raising and lowering the core barrels. Once the receiving container has been positioned in the drilling axis approximately beneath the supply position of the core barrel, the latter can then be lowered and thus introduced into the receiving container.

In this position of the receiving container in the drilling axis, a closure cap can also be screwed, preferably by means of the drill drive, onto the receiving opening of the receiving container and thus the drill core can be closed in pressure-tight manner in the receiving container.

Alternatively, one method variant consists in that the core barrel is moved to the receiving container at the storage location and is introduced into the receiving container there. To this end, the core barrel with the drill core is moved by means of a manipulating means out of the drilling axis until it is arranged above or beneath the receiving container and is arranged axially aligned therewith. Then, by axially moving the core barrel, the latter can be introduced into the receiving container. Then the receiving container can be closed directly at the storage location by applying a closure cap.

The invention in principle also comprises a receiving container for receiving a drill core for an underwater drilling device, as has been previously described, or for a method for procuring drill cores, as has likewise previously been described. The receiving container is characterized in that it has a tubular base body with at least one receiving opening, and in that the at least one receiving opening once it has received a drill core can be closed in pressure-tight manner by means of a closure cap. Furthermore, the receiving container may have a safety valve to counteract excess pressure.

The at least one closure cap may be connected to the receiving opening in any suitable manner. Preferably, a pressure relief valve may also be provided on the closure cap, so that upon lifting the closed receiving container any excess pressure beyond a specified limit pressure which may possibly arise due to a change in the state of aggregation of elements in the drill core is avoided.

One advantageous development of the receiving container according to the invention consists in that a temperature control means is provided on the base body, with which means an interior of the receiving container can be heated and/or cooled. As a result, the temperature and hence the pressure within the receiving container can be influenced directly. In particular, by cooling the receiving container sublimation for example of methane hydrate or another substance out of the drill core and hence a pressure increase in the receiving container can be counteracted.

BRIEF DESCRIPTION OF THE DRAWINGS

The invention will be described further below with reference to preferred examples of embodiment, which are illustrated schematically in the drawings. The drawings show.

DETAILED DESCRIPTION

Figure 1:
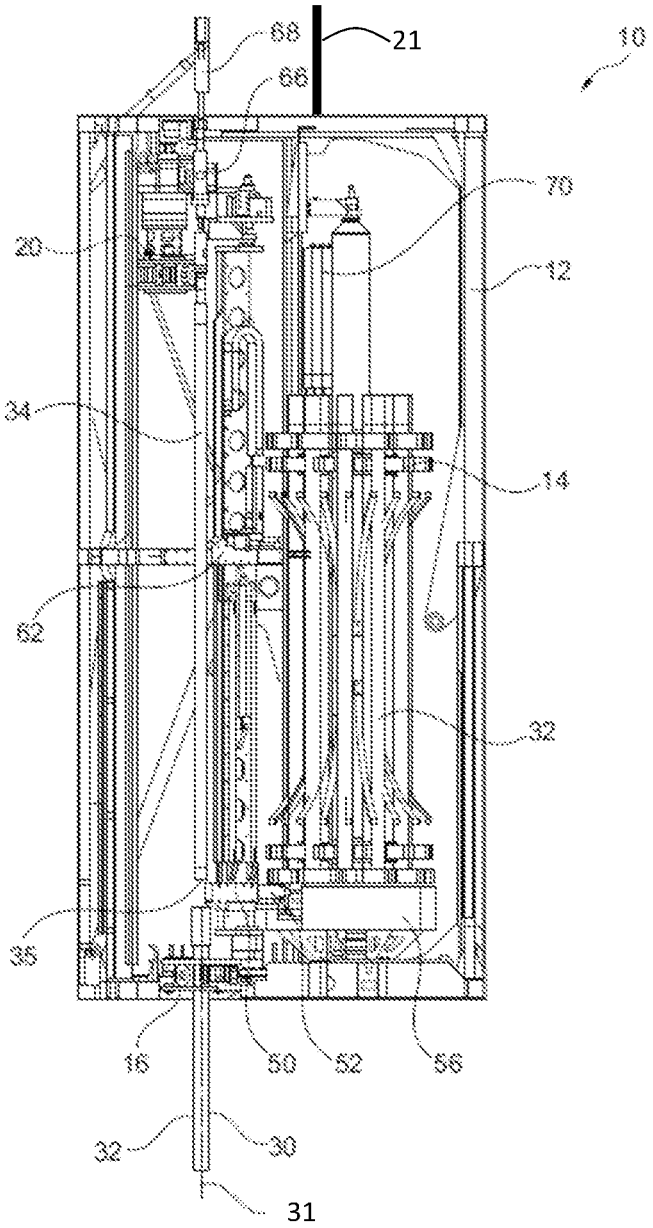
FIG. 1 a first embodiment of an underwater drilling device according to the invention in a first method step.
Figure 2:
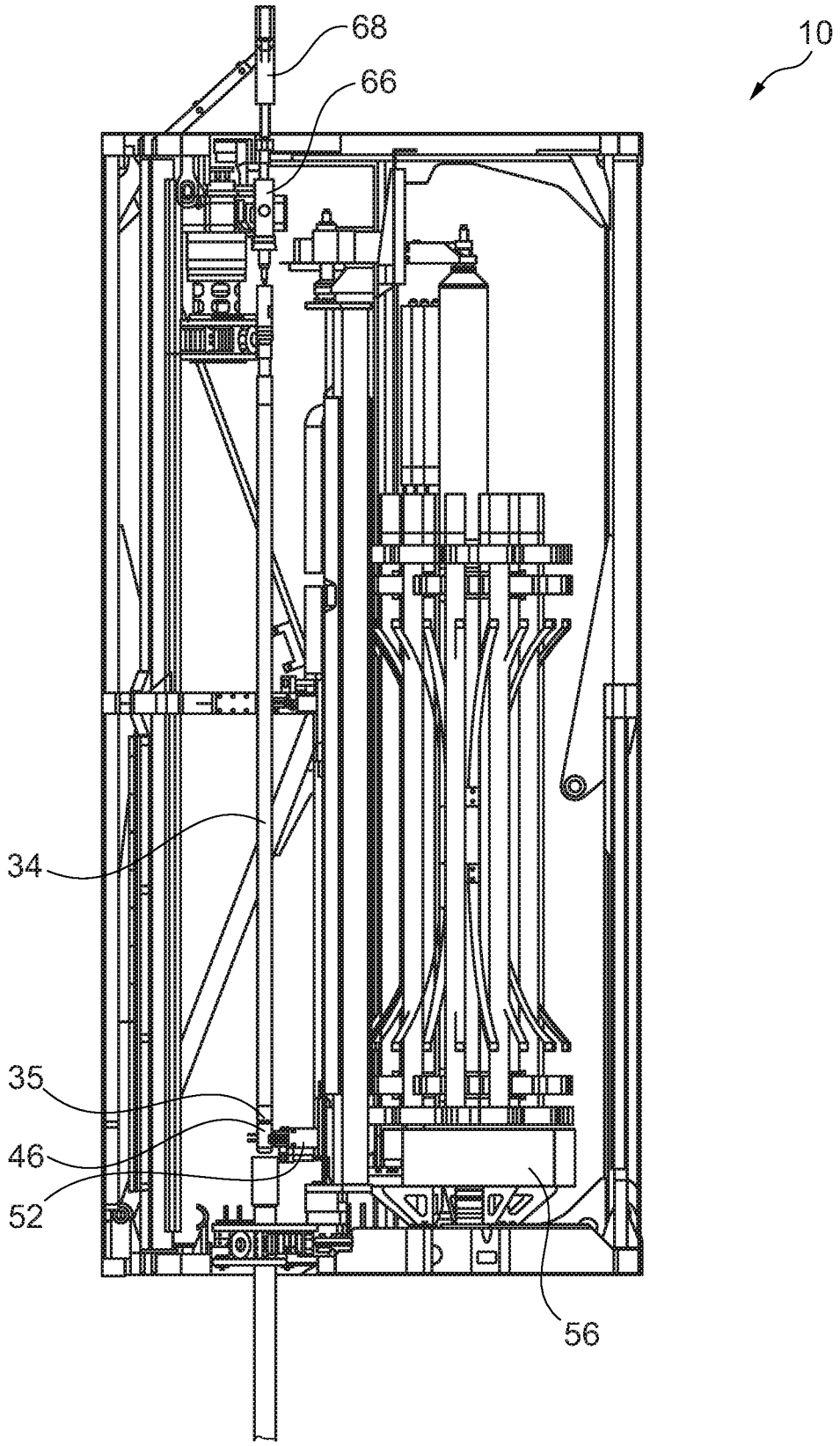
FIG. 2 a side view of the underwater drilling device of FIG. 1 in a second method step.
Figure 3:
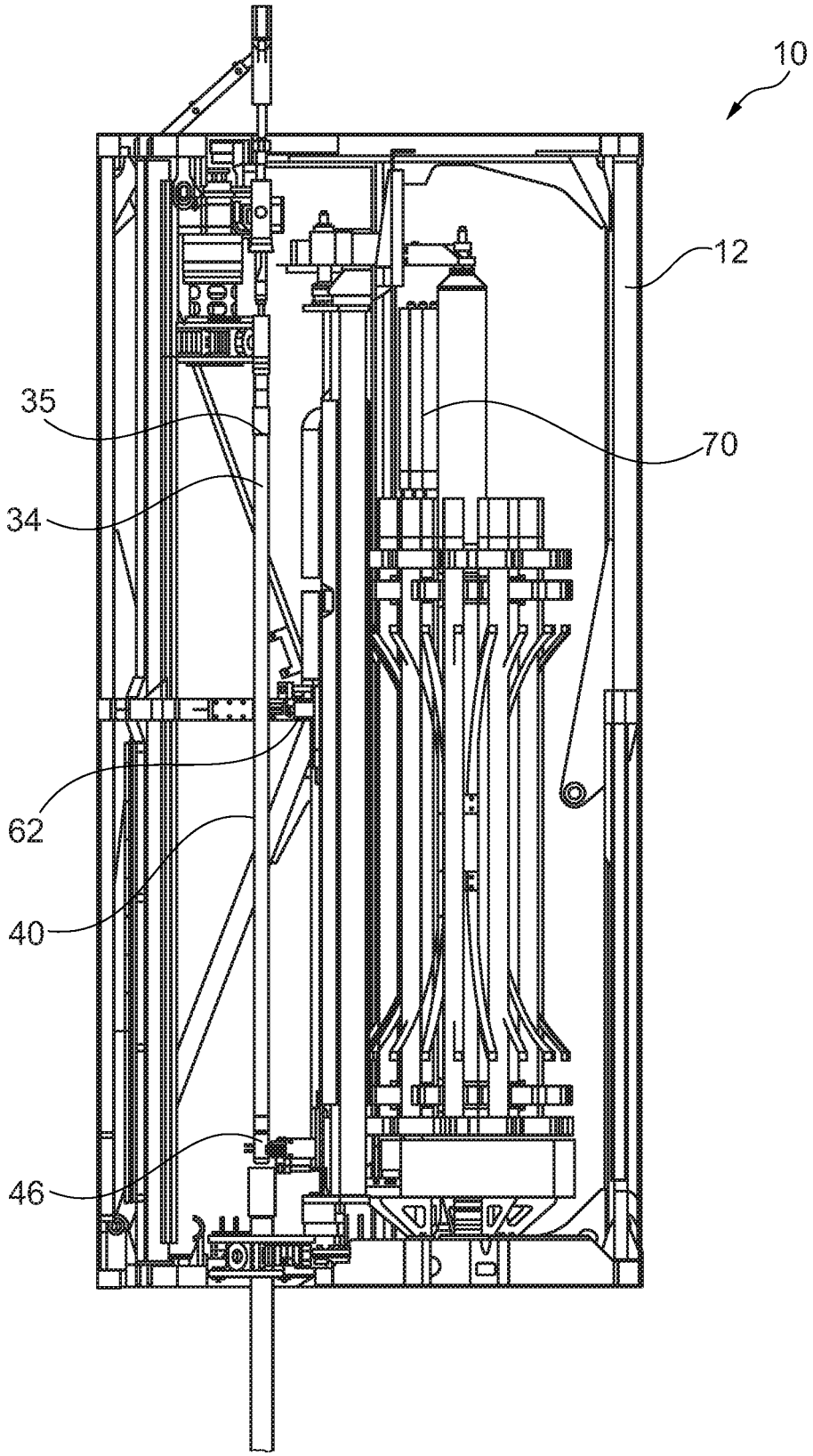
FIG. 3 a side view of the underwater drilling device of FIGS. 1 and 2 in a third method step.

In a first embodiment of the underwater drilling device 10 according to the invention of FIGS. 1 to 3, a box-like base frame 12 which in its upper region has a drill drive 20 for drilling out a drill string 30 which is constructed of individual tubular drill string elements 32 is illustrated schematically. Within the lowermost drill string element 32 there is a core barrel 34 which receives a drill core during drilling.

The drill core while the core barrel is being drawn is held in the core barrel 34 by friction or by special core catching means. The drilling-out of the drill string 30 takes place in individual drilling steps, with, in a manner which is known in principle, a drill string element 32 being picked out of a storage region 14, which in the example of embodiment illustrated is designed as a revolving carousel, by means of a gripper arm 62 of a manipulating means 60 and brought to the drill drive 20. On the lowermost drill string element there is provided a drill head. The drill drive 20 is mounted and driven on the base frame 12 in vertically movable manner in order to sink the drill string 30 by a further drilling step. The base frame 12 is connected to a supply vessel by way of a marine umbilical 21. The marine umbilical 21 may in this case be provided both for supplying power, in particular electric power or hydraulic fluid, and as a data line for data communication. Furthermore, the marine umbilical 21 may also be designed as a cable with which the underwater drilling device 10 can be lowered and raised again in addition to the supplying function.

In the illustration of FIG. 1, the drill drive 20 is pivoted out of a drilling axis 31 of the drill string 30. The upper drill string element 32 of the drill string 30 is held on the base frame 12 by a holding means 16, which preferably comprises clamping cylinders. By means of a lifting cable with a catching means 66, a core barrel 34 is grasped in the drill string element 30, and is pulled out of the drill string 30. The core barrel 34 can alternatively or subsidiarity also be pulled upwards by the vertically movable and pivotable gripper arm 62 or by a lifting cylinder 68 which is illustrated only schematically in FIG. 1.

Once the core barrel 34 has been pulled out of the drill string 30 into an upper position, as illustrated in FIG. 1, the core barrel 34 is separated from the drill string 30 and the upper drill string element 32.

To close a lower barrel end 35 of the core barrel 34, a cap-like or cup-shaped closure cap 46 is picked up from a magazine 56 and pivoted into the drilling axis 31 beneath the core barrel 34 by means of a lower manipulator arm 52 of the closing means 50, as illustrated clearly in FIG. 2.

The closure cap 46 has at its upper end an internal screw thread which corresponds to an external thread on the lower barrel end 35 of the core barrel 34. By actuating the drill drive 20 and the lifting device 68, the core barrel 34 can be screwed into the screw thread of the closure cap 46. This is done in such a way that the lower barrel end 35 is closed in pressure-tight manner. Preferably a corresponding sealing means, in particular a sealing ring, can be provided on the screw connection.

FIG. 3 illustrates the core barrel 34 with the closure cap 46 screwed on at the bottom. In a corresponding or similar manner, the upper barrel end 35 of the core barrel 34 can be closed with a further closure cap. Once the two barrel ends 35 of the core barrel 34 with the drill core arranged therein are closed in pressure-tight manner, this arrangement forms a pressure-tight receiving container 40 with the core barrel 34. This receiving container 40 can then be brought into a storage means 70 on the base frame 12 by way of the manipulating means 60, in particular by means of the gripper arm 62.

If further drill string elements 32 and further core barrels 34 are present, these method steps for pressure-tight enclosing of the drill core in a collecting container 40 can be repeated until all the core barrels 34 with drill cores are obtained. Upon dismantling the drill string 30, the outer drill string elements 32 can likewise be pulled out of a drill hole again in known manner and conveyed back into the corresponding storage region 14 on the base frame 12.

Figure 4:
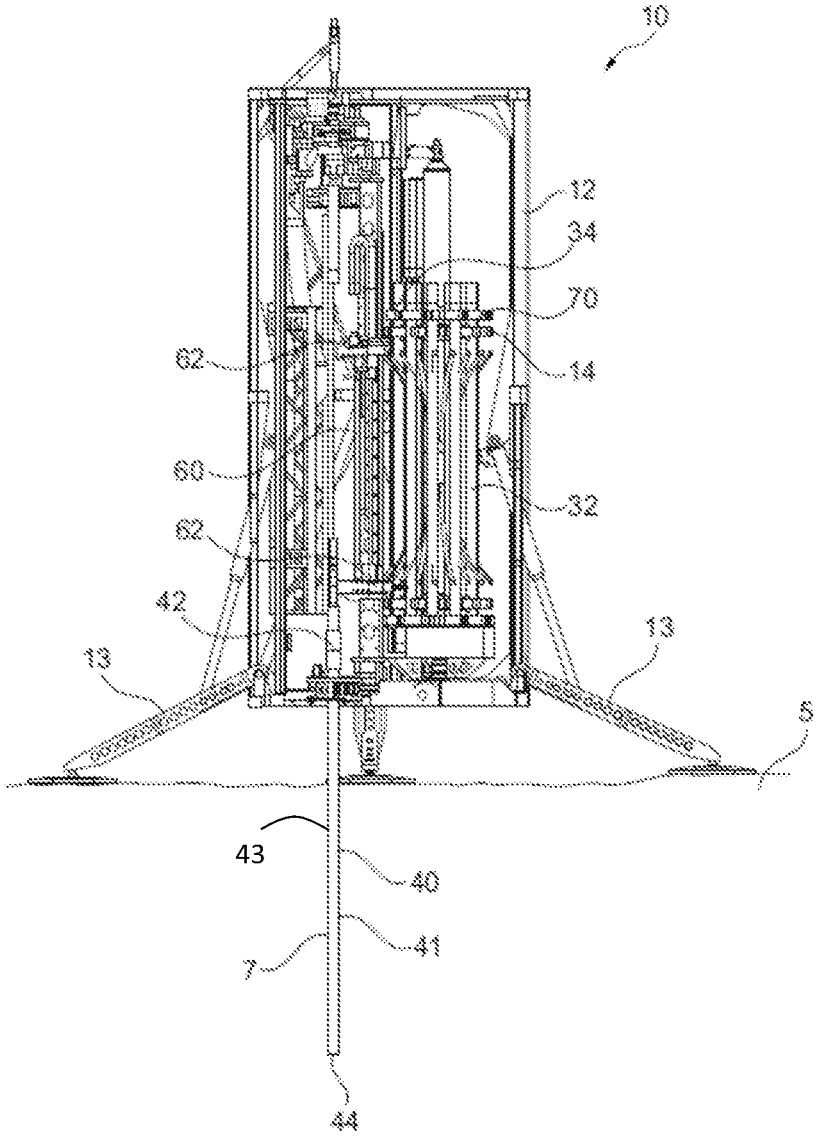
FIG. 4 a side view of a second embodiment of an underwater drilling device according to the invention in a first method step.
Figure 5:
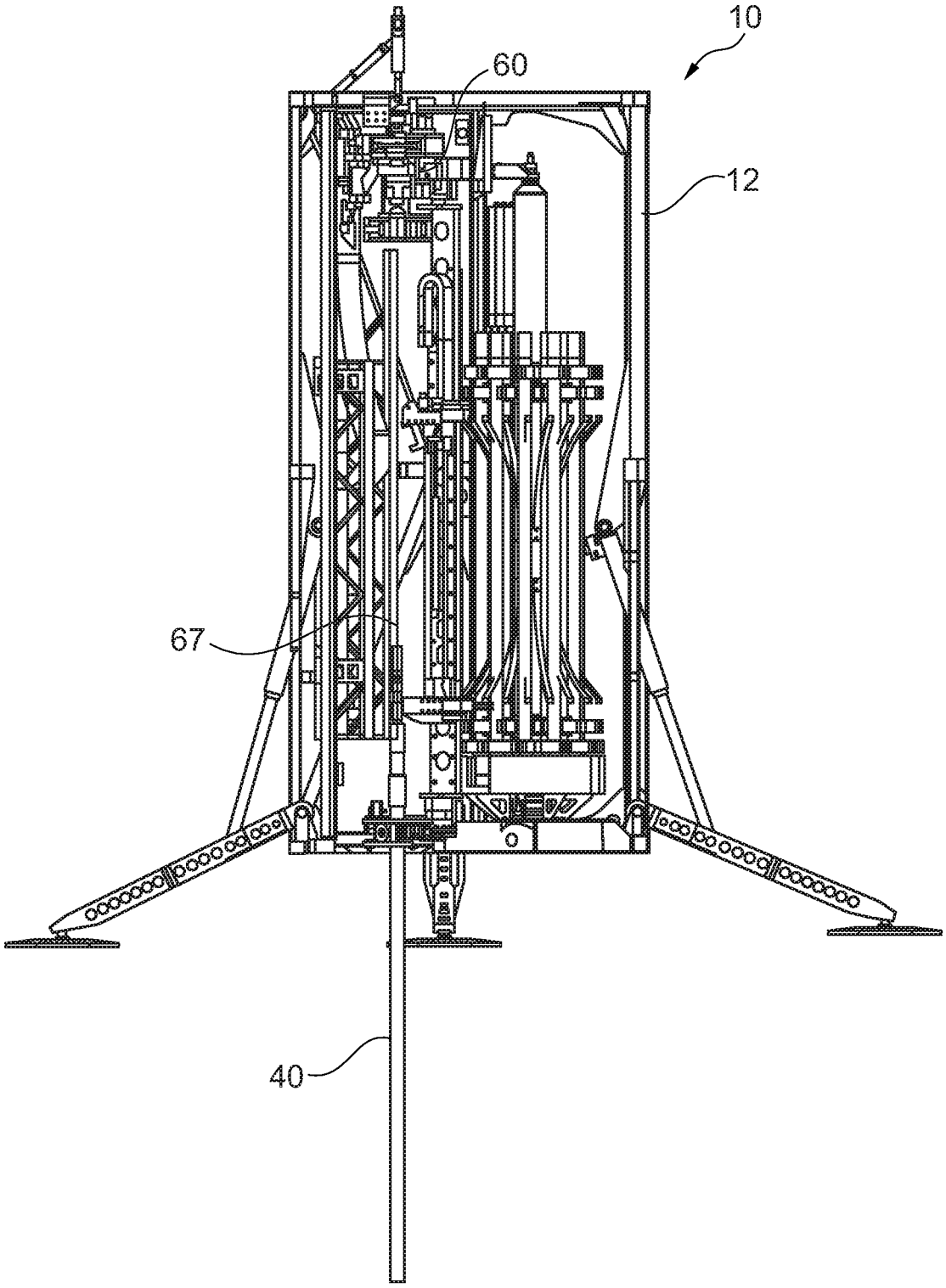
FIG. 5 a side view of the underwater drilling device of FIG. 4 in a second method step.
Figure 6:
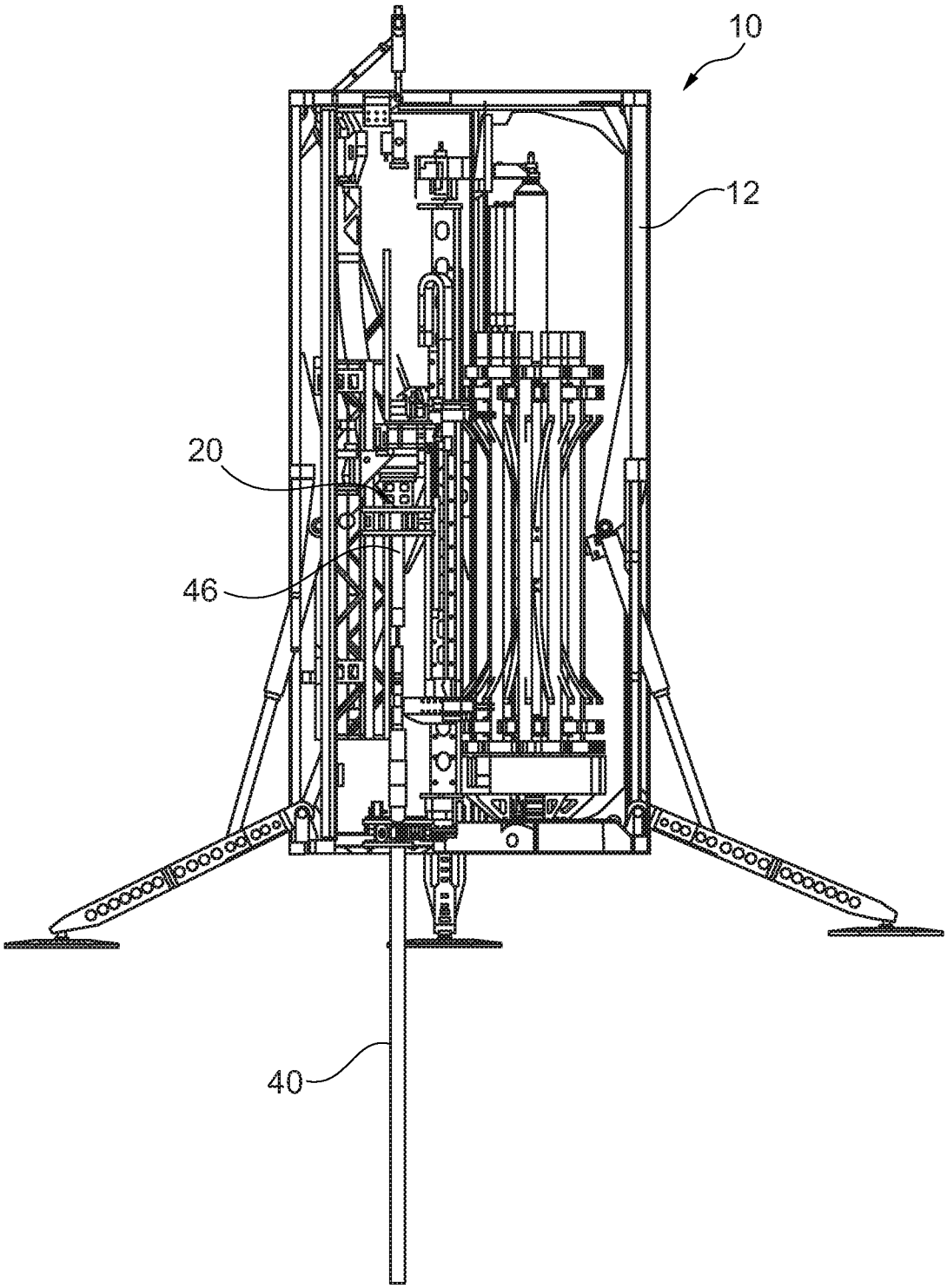
FIG. 6 a side view of the underwater drilling device of FIGS. 4 and 5 in a third method step.

FIGS. 4 to 6 illustrate a further embodiment of an underwater drilling device 10 according to the invention. In these figures, a base frame 12 of the underwater drilling device 10 with fold-out feet 13 which are in principle present is shown, by which feet the base frame 12 is placed on a bed of a body of water 5. In the illustrations of FIGS. 4 to 6, the drilling-out and retrieval of a drill string 30 has already been carried out, with the retrieved individual drill string elements 32 being deposited in a storage region 14 on the base frame 12 and the core barrels 34 with the drill cores arranged therein in a storage means 70, not shown further.

For pressure-tight enclosing of the core barrels 34 with the drill cores located therein, first of all a cartridge-like receiving container 40 is picked up out of the storage means 70, which may also be the storage region 14 for the drill string elements 32, by means of a manipulating means 60 with at least one gripper arm 62 and introduced into a receiving bore 7 in the bed of the body of water 5, as illustrated clearly in FIG. 4. The receiving bore 7 may in this case be in particular the bore from which the drill string 30 has been pulled out. In this case, the receiving bore 40 may also be of enlarged diameter compared with the bore originally created. The receiving container 40 which is open at the top is designed in cartridge-like manner with a cylindrical, tubular base body 41 and with a lower closed base 44. A temperature control means 43 is provided on the base body 41, with which means an interior of the receiving container 40 can be heated and/or cooled. As a result, the temperature and hence the pressure within the receiving container 40 can be influenced directly. On an underside of the base 44 there may be provided a cutting means with which the receiving container 40 can be introduced more easily into the bed of the body of water 5. At its upper end, the cylindrical base body 41 has a receiving opening 42 for receiving a core barrel 34.

By means of a manipulating means 60, which may in particular comprise a lifting cable 67, a core barrel 34 can be removed from the storage means 70 and, once it has been introduced into the drilling axis, can be introduced through the receiving opening 42 into the cup-like receiving container 40, as is illustrated in FIG. 5.

According to FIG. 6 a closure cap 46 can be inserted into the drill drive 20 and the latter can be moved along the drilling axis downwards to the receiving container 40. The upper closure cap 46 may in this case have been removed from a magazine, not illustrated further, on the base frame 12 by a corresponding manipulating means and have been supplied to the drill drive 20. Once the receiving container 40 has been closed in pressure-tight manner by corresponding screwing-on of the upper closure cap 46, and hence the core barrel inserted therein with the drill core is closed off in pressure-tight manner, the closed receiving container 40 can be pulled out of the receiving bore 7 again and be brought back into the storage means 70. Finally, the operation can be repeated until all the core barrels 34 with drill cores which have been obtained are enclosed in pressure-tight manner in a receiving container 40.

Figure 7:
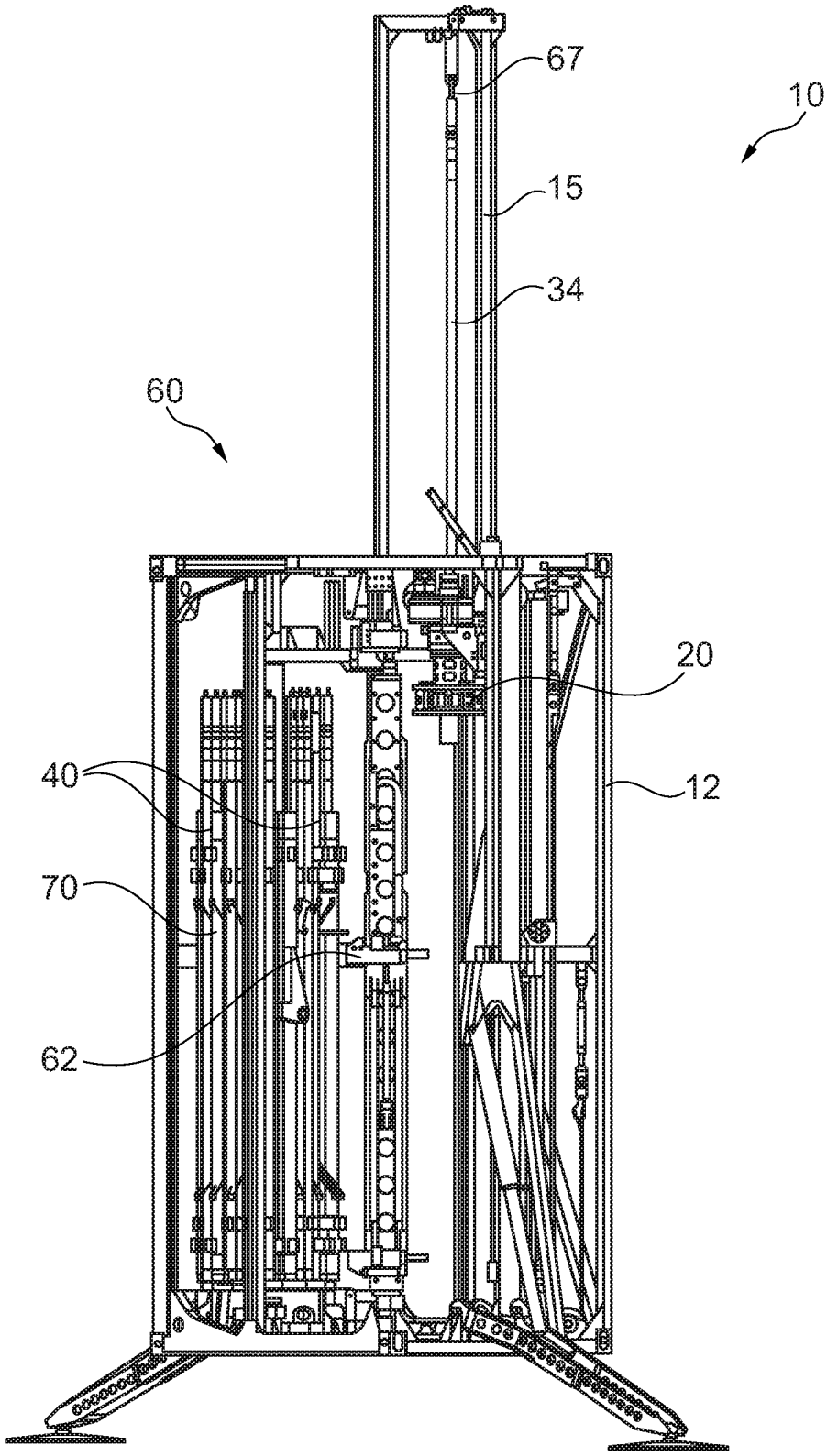
FIG. 7 a side view of a third embodiment of an underwater drilling device according to the invention in a first method step.
Figure 8:
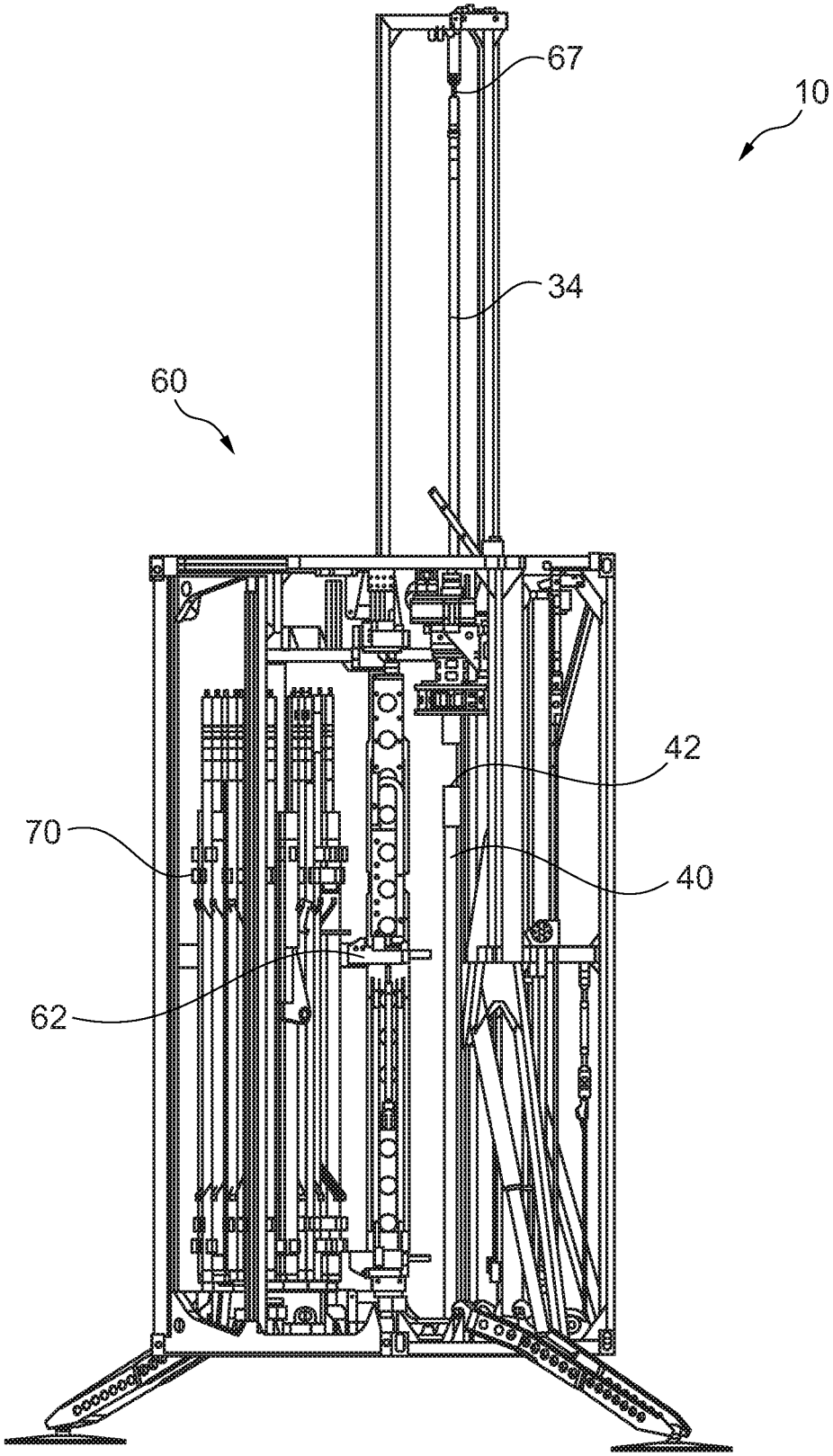
FIG. 8 a side view of the underwater drilling device of FIG. 7 in a second method step.
Figure 9:
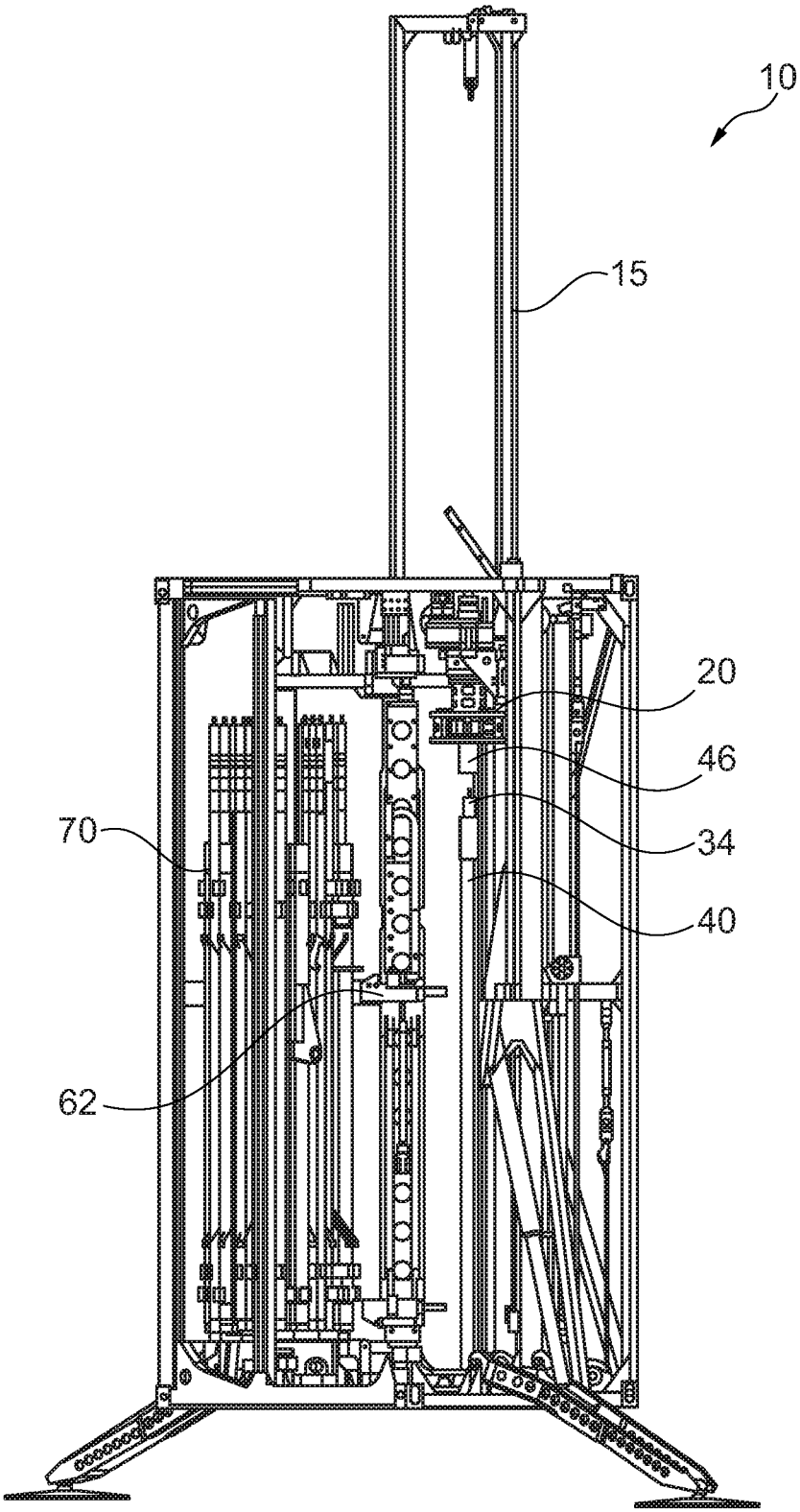
FIG. 9 a side view of the underwater drilling device of FIGS. 7 and 8 in a third method step.

A third embodiment of an underwater drilling device 10 according to the invention emerges from FIGS. 7 to 9. In this case, the basic structure with a base frame 12, a drill drive 20 and a storage means 70 largely corresponds to the structure of the underwater drilling devices 10 previously described. Unlike the embodiments previously described, a yoke-like structure 15 is provided in the direction of a drilling axis on the upper side of the base frame 12. The drill string projecting from a bed of a body of water is not illustrated anew in FIGS. 7 to 9.

Once the drilling-out has been terminated, or after each drilling advance which corresponds to the length of one drill string element, the drill drive 20 is moved upwards along the base frame 12 on a corresponding linear guide and then spaced apart laterally from a drilling axis, as can be inferred from FIG. 7. Then a lifting cable 67, which is guided on the yoke-like structure 15 by way of a cable deflection means, is lowered downwards to the end of the drill string which is open at the top. By way of a connecting means, a first core barrel 34 is picked up and pulled out of the drill string upwards into the region of the yoke-like structure 15, this being illustrated in FIG. 7.

Then an empty receiving container 40 can be removed from a carousel-like storage means 70 by way of a manipulating means 60 with a gripper arm 62, and positioned in the region of the drilling axis beneath the core barrel 34 which has been pulled upwards, as can be seen from FIG. 8. In the present case, the manipulating means 60 comprises a plurality of components, which include the lifting cable 67 and also the gripper arm 62.

Once the receiving position of the receiving container 40 illustrated in FIG. 8 has been reached, the upper core barrel 34 is lowered along the drilling axis by the lifting cable 67 by way of a cable winch, not shown, and thus introduced through the upper receiving opening 42 into the receiving container 40 which is closed off at the bottom. Then the lifting cable 67 is detached from the core barrel 34 and pulled back upwards again to the upper portion of the yoke-shaped structure 15, as shown in FIG. 9. Finally, then the drill head 20 can be provided with a closure cap 46 from a magazine, not shown, with a supply element, likewise not shown, and be pivoted back into the drilling axis. Then the drill drive 20 is moved downwards and by turning the closure cap 46 the latter can be screwed onto the upper receiving opening 42 of the receiving container 40, so that the inserted core barrel 34 with the drill core located therein is enclosed in pressure-tight manner in the receiving container 40.

Then the closed receiving container 40 can be brought back into the storage means 70 by way of the gripper arm 62, after which a further core barrel 34 can be introduced into the drill string 30. Prior to or after this, a further drill string element 32 can be placed on the existing drill string 30 and be screw-connected thereto. After renewed drilling, a further method step for closing a further core barrel 34 can be carried out.

Figure 10:
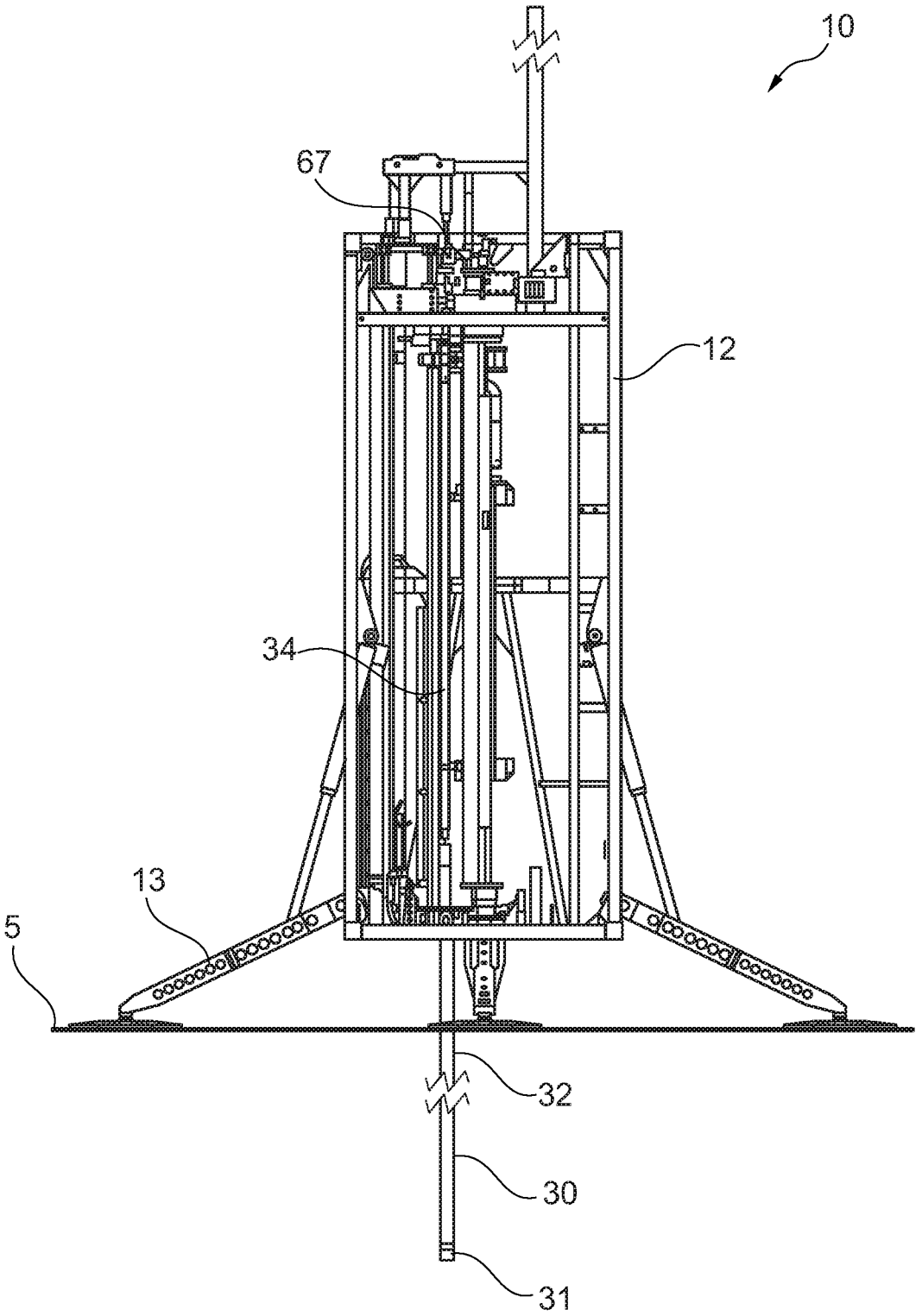
FIG. 10 a side view of a fourth embodiment of an underwater drilling device according to the invention in a first method step.
Figure 11:
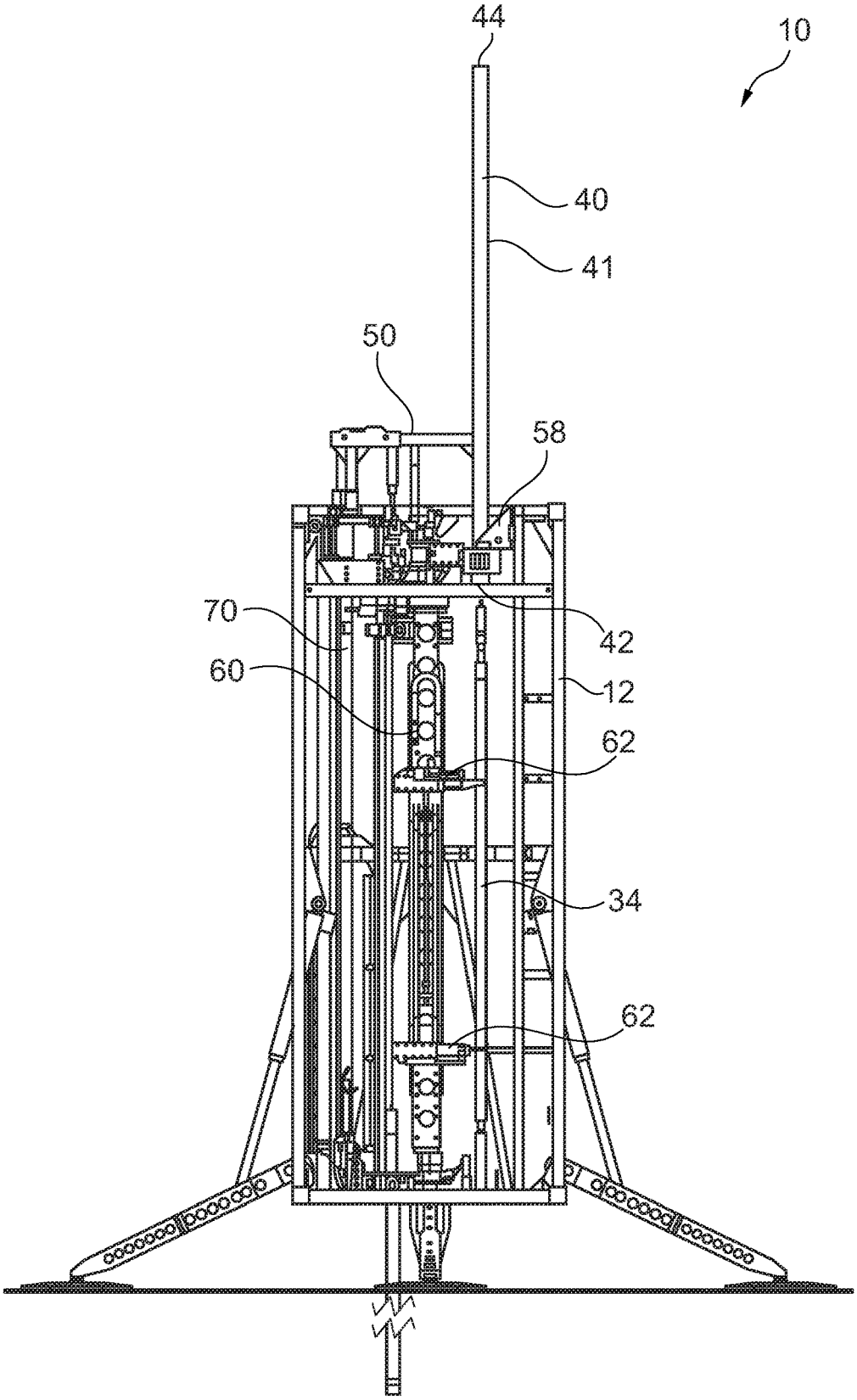
FIG. 11 a side view of the underwater drilling device of FIG. 10 in a second method step.
Figure 12:
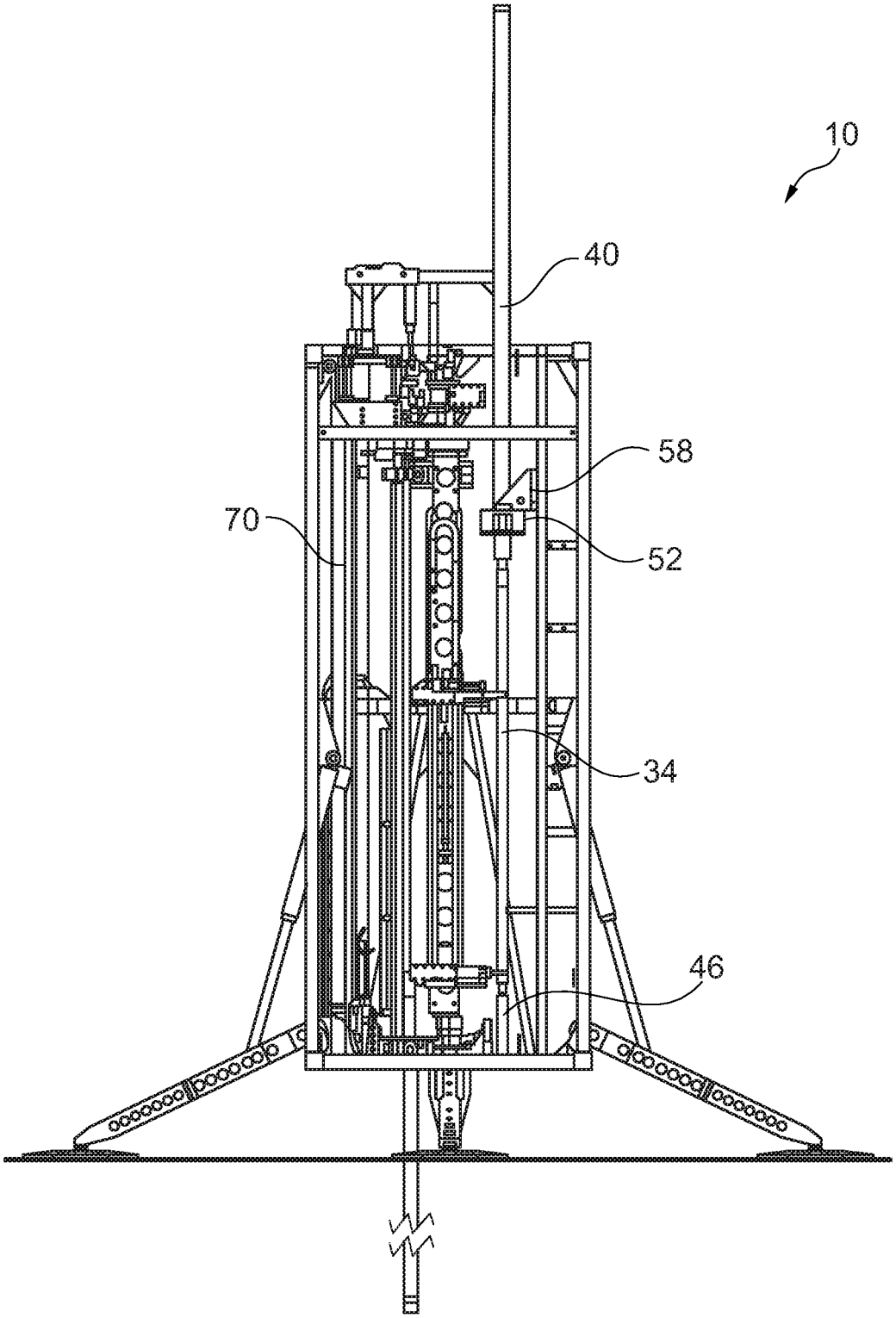
FIG. 12 a side view of the underwater drilling device of FIGS. 10 and 11 in a third method step.

One further variant embodiment of the invention emerges from FIGS. 10 to 12. In the underwater drilling device 10 according to the invention illustrated, likewise a base frame 12 with a similar structure as for the previously described embodiments is yielded. The base frame 12 is placed on a bed of a body of water 5 by way of fold-out feet 13.

From this transfer position illustrated in FIG. 10, the core barrel 34 is picked up by means of a manipulating means 60, which in the example of embodiment has two gripper arms 62, and pivoted away laterally out of the drilling axis into a closure position which is illustrated in FIG. 11.

By means of a closing means 50 which has a movable manipulator arm, a receiving container 40 is moved out of a storage means 70 upwards to above the base frame 12 and moved laterally over the core barrel 34 into the closure position.

In contrast to the embodiments previously described, the receiving container 40 has an inverted position, with the closed base 44 of the cylindrical base body 41 being at the top, while the receiving opening 42 is directed downwards to the core barrel 34. Then with a gripping and displacement unit 58 of the closing means 50 the receiving container 40 can be moved downwards over the core barrel 34 which is located thereunder, as illustrated clearly in FIG. 12. After the movement downwards, the receiving container 40 can be screwed onto a closure cap 46 arranged at the bottom by way of a rotary drive 52 on the gripping and displacement unit 58, with the core barrel 34 according to the invention being enclosed in pressure-tight manner in the receiving container 40. Finally, the closed receiving container 40 can be brought back into the storage means 70 by way of the gripper arms 62. Then, after the next drilling step the operation can be repeated for pulling a further core barrel 34 and closing a further receiving container 40.

The invention claimed is:

1. An underwater drilling device for procuring at least one drill core of a bed of a body of water, comprising:

a base frame which is designed to be lowered in the body of water and to be placed on the bed of the body of water, a drill drive for rotatably driving a drill string about a drilling axis, wherein the drill string includes at least one tubular drill string element and additionally at least one core barrel for receiving the at least one drill core is provided in the drill string, and storage that is spaced apart from the drilling axis and configured to store at least one receiving container for the at least one drill core, the at least one receiving container includes a tubular base body that is closable with at least one receiving opening for introducing the at least one drill core, wherein the at least one tubular drill string element is used as the at least one receiving container, and wherein barrel ends of the at least one tubular drill string element, once it has been removed from the drill string, can be enclosed in a pressure-tight manner in the at least one receiving container on the base frame underwater by a closing device configured to close the at least one receiving opening of the at least one receiving container in the pressure-tight manner with a closure cap once the at least one drill core has been received.

2. The underwater drilling device according to claim 1, wherein the closing device has at least one rotary drive which is designed to turn the closure cap with screw thread relative to the at least one receiving container, in which case a suitable thread being arranged on barrel ends of the at least one receiving opening.

3. The underwater drilling device according to claim 1, wherein the at least one core barrel can be pulled out of the drill string by a manipulator, and the manipulator and the closing device are movable relative to each other.

4. The underwater drilling device according to claim 3, wherein the manipulator is a cable winch with lifting cable, or has at least one lifting cylinder.

5. The underwater drilling device according to claim 1, wherein the base frame is connected to a supply vessel by way of a marine umbilical.

6. A method for procuring at least one drill core of a bed of a body of water with an underwater drilling device, the method comprising:

lowering a base frame of the underwater drilling device in the body of water for placement on the bed of the body of water, rotatably driving a drill string about a drilling axis with a drill drive, wherein the drill string includes at least one tubular drill string element and additionally at least one core barrel for receiving the at least one drill core is provided in the drill string, and storing at least one receiving container for the at least one drill core in storage that is spaced apart from the drilling axis, the at least one receiving container includes the at least one tubular drill string element that is closable with at least one receiving opening for introducing the at least one drill core, wherein the at least one tubular drill string element is used as the at least one receiving container, and the at least one drill core, once it has been removed from the drill string, is enclosed in a pressure-tight manner in the at least one receiving container on the base frame underwater by a closing device configured to close the at least one receiving opening of the at least one receiving container in the pressure-tight manner with a closure cap once the at least one drill core has been received.

7. The method according to claim 6, wherein the closure cap is screwed on with a screw thread to close the at least one receiving container.

8. The method according to claim 6, wherein the at least one core barrel is pulled out of the at least one tubular drill string element by a manipulator, the at least one core barrel and the at least one receiving container are moved and axially aligned relative to each other, and after axial alignment of the at least one core barrel and the at least one receiving container, the at least one core barrel with the at least one drill core is moved into the at least one receiving container by relative axial movement of the at least one core barrel and the at least one receiving container.

9. The method according to claim 6, wherein a receiving bore for the at least one receiving container is created beneath the base frame in the bed of the body of water, and the at least one core barrel is introduced into the at least one receiving container in the receiving bore.

10. The method according to claim 6, wherein the at least one receiving container is moved into the drilling axis.

11. The method according to claim 6, wherein the at least one core barrel is moved to the at least one receiving container at the storage and is introduced into the at least one receiving container there.

12. The method according to claim 6, wherein a temperature control means is provided on the tubular base body, with which means an interior of the at least one receiving container is heated and/or cooled.

* * * * *